US008646815B2

(12) United States Patent
Timothy et al.

(10) Patent No.: US 8,646,815 B2
(45) Date of Patent: Feb. 11, 2014

(54) GATE LATCH

(75) Inventors: E. Erik Timothy, Apollo Beach, FL (US); Bryan Fern, Lithia, FL (US)

(73) Assignee: Nationwide Industries, Inc., Tampa, FL (US)

( * ) Notice: Subject to any disclaimer, the term of this patent is extended or adjusted under 35 U.S.C. 154(b) by 867 days.

(21) Appl. No.: 12/621,080

(22) Filed: Nov. 18, 2009

(65) Prior Publication Data

US 2010/0123321 A1 May 20, 2010

Related U.S. Application Data

(60) Provisional application No. 61/115,663, filed on Nov. 18, 2008.

(51) Int. Cl.
*E05C 5/00* (2006.01)

(52) U.S. Cl.
USPC ..... 292/69; 292/DIG. 29

(58) Field of Classification Search
USPC ..... 292/69, 216, 194, 195, DIG. 29, 230, 292/231; 70/100, 101
See application file for complete search history.

(56) References Cited

U.S. PATENT DOCUMENTS 7,201,030 B2 * 4/2007 Timothy ..... 70/101

* cited by examiner

*Primary Examiner* — Carlos Lugo
*Assistant Examiner* — Mark Williams
(74) *Attorney, Agent, or Firm* — George R. McGuire; Bond Schoeneck & King, PLLC

(57) ABSTRACT

A gate latch system including a button assembly, a latch assembly, and a keeper assembly. The gate latch assembly can be opened from the side of the gate opposite the latch through the use of a spindle extending from a button assembly on one side of the gate to a latch assembly located on the opposite side of the gate and which includes a latch retention member. The latch assembly and button assembly are configured so that the spindle extends from the button assembly to the latch assembly through the gate opening such that there is no need to make a hole through the gate and/or covering to accommodate the spindle.

16 Claims, 10 Drawing Sheets

GATE LATCH

CROSS-REFERENCE TO RELATED APPLICATIONS

The present application claims priority to U.S. Provisional Application No. 61/115,163, filed Nov. 18, 2008, which is expressly incorporated by reference herein.

BACKGROUND OF THE INVENTION

1. Field of the Invention

The present invention relates to latches, and, more particularly, to gate latches.

2. Description of the Related Art

Locking gate latches are conventional. For example, U.S. Pat. No. 7,201,030 to Timothy discloses a gate lock device with front and rear units that are mounted on opposite sides of a structure such as a gate post. Timothy also discloses a key-actuated rear lock in a second housing of the rear unit. Many prior art gate latches, including the Timothy patent, teach the use of one or two spindles that are disposed throughout the gate structure associated with the latch. Prior art gates have not, however, employed a spindle of adjustable length that is located on the outside of the gate post, as in the present invention.

BRIEF SUMMARY OF THE INVENTION

In view of the foregoing, it should be apparent that a need still exists in the prior art for a gate locking device that avoids the problems inherent in the prior art systems. Accordingly, it is a primary object of the present invention to provide a gate latch assembly that uses a spindle of adjustable length located outside the gate structure.

It is another object and advantage of the present invention to provide a gate latch system adapted to secure a movable gate element relative to a fixed post element which can be locked and unlocked from both sides of the gate, including the side of the gate opposite the latch.

Another object and advantage of the present invention is to provide a gate latch that does not require any through holes through either the gate or the fixed post.

Yet another object and advantage of the present invention is to provide a gate latch assembly with a spindle that can be cut to size depending on gate thickness.

It is another object and advantage of the present invention to provide a gate latch assembly that can be installed in right-handed or left-handed configurations.

Another object and advantage of the present invention is to provide a gate latch assembly that is inexpensive, easy to install, and comprised of relatively few and/or simple-to-manufacture component parts.

In accordance with the foregoing objects and advantages, the present invention comprises a latch system adapted to secure a movable gate relative to a fixed post, said system comprising a latch assembly adapted for mounting on said fixed post, a button assembly adapted for mounting on said fixed post, a keeper assembly adapted for mounting on said gate, and a spindle external to said fixed post; said keeper assembly comprising a keeper housing, a keeper pin; said button assembly comprising a button base mountable on said fixed post, a button housing mounted on said button base, a first end of said spindle extendably mounted on said button base; said latch assembly comprising a latch base mounted on said fixed post, a latch housing mounted on said latch base, a latch pivotally coupled to said latch housing by a pivot, the latch being pivotal with respect to the latch housing between a first position wherein an outward end of the latch engages the keeper pin and a second position wherein the latch disengages from the keeper pin; said latch assembly being adapted to be cooperatively arranged with said keeper assembly so that said outward end of said latch engages said keeper pin when said movable gate is in proximity to said fixed post; and said spindle being movable into an extended position wherein a second end of said spindle is adapted to pivot said latch into said second position.

Another embodiment of the present invention is a gate latch system wherein the button base is adapted for adjusting said button housing between a first position wherein said spindle is extendably mounted on the left side of said button base, and a second position wherein said spindle is extendably mounted on the right side of said button base.

A further embodiment of the present invention provides a gate latch system wherein the latch base is adapted for adjusting said latch base between a first position wherein said spindle is movable into said extended position on the left side of said latch base, and a second position wherein said spindle is movable into said extended position on the right side of said latch base.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
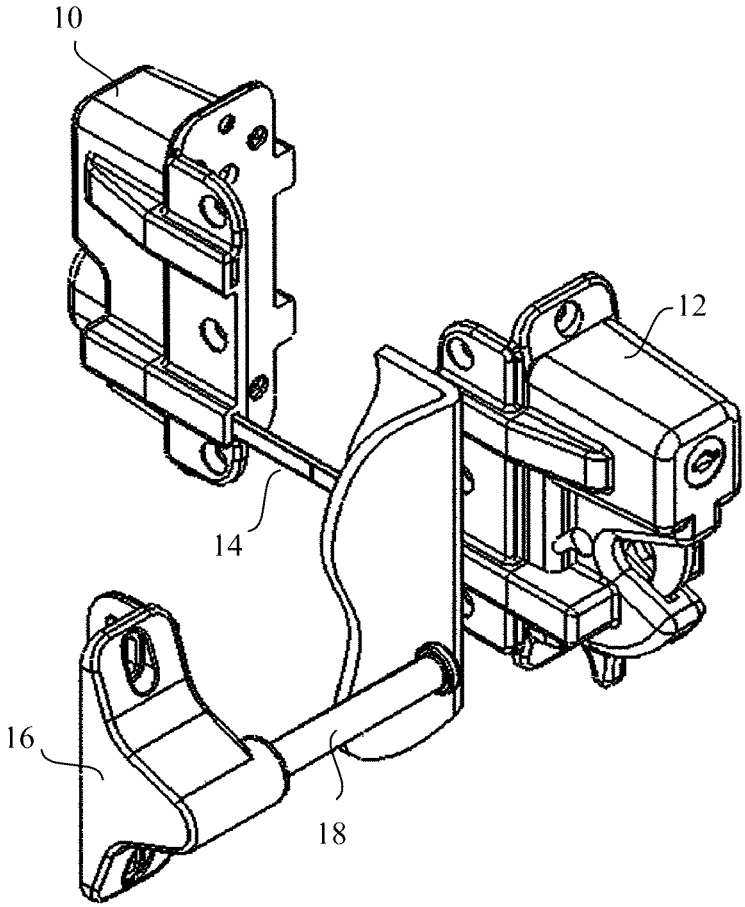
FIG. 1 is a perspective view of the latch assembly, button assembly, and keeper assembly according to one embodiment of the present invention.

Referring now to the drawings, wherein like reference numerals refer to like parts throughout, there is seen in FIG. 1 a perspective view of the latch assembly 10, button assembly 12, and keeper assembly 16 according to one embodiment of the present invention. The button assembly 10 is mounted to one side of a fixed gate post or other structure 70 (shown in FIG. 9) and is in communication with the latch assembly 12 via spindle 14. In a preferred embodiment latch assembly 12 is mounted on the opposite side of the gate post to which the button assembly is attached. When the gate is in the closed, latched configuration, the keeper assembly 16 is in reversible communication with latch assembly 12 via keeper pin 18.

FIG. 1 shows the gate latch in the closed, latched configuration, although the keeper pin is not in communication with the latch assembly.

The latch assembly, the button assembly, and the spindle are organized such that spindle 14 does not need to go through the gate or other structure itself, but is external to the gate or gate post and extends through the space between the movable gate and the fixed gate post. This design avoids the need to drill holes in the gate or other structure to accommodate the spindle and otherwise simplifies installation of the gate latch assembly.

Figure 2:
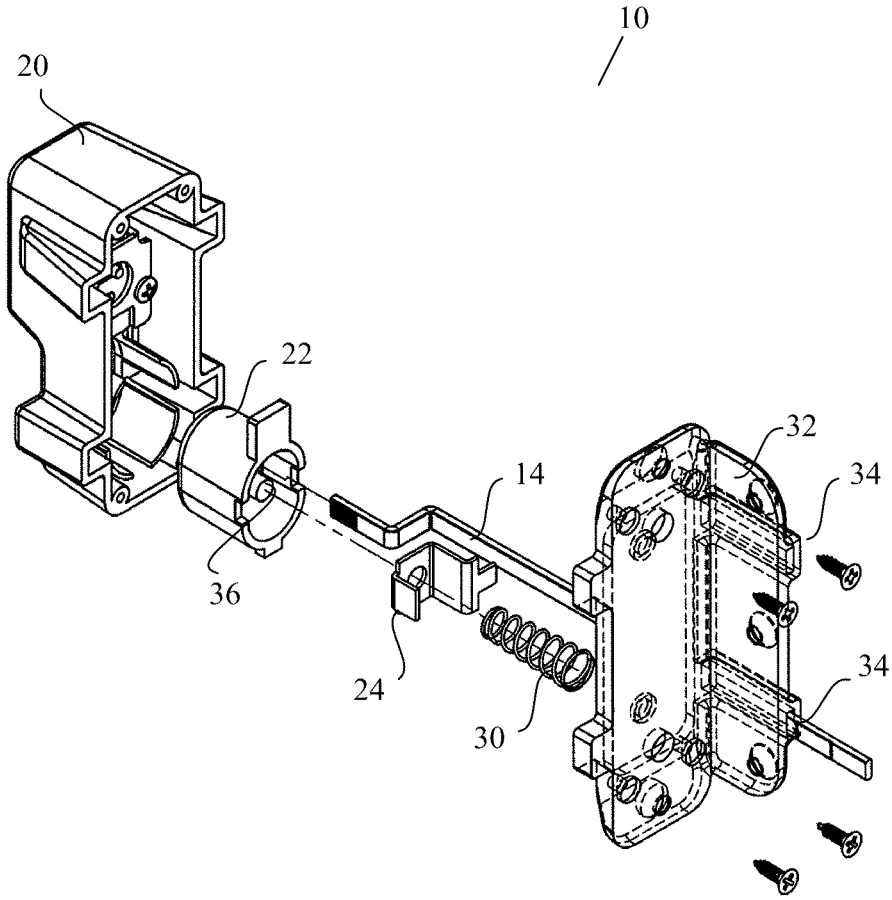
FIG. 2 is an exploded view of the button assembly according to one embodiment of the present invention.

FIG. 2 is an exploded view of one embodiment of the button assembly 10. When fully assembled, button housing 20 retains the latch button 22, the button clip 24, and the spring 30. A first end of spindle 14 fits inside the latch button, and the second end of the spindle is disposed through a hollowed spindle retainer 34 on the button base 32. As the button housing and the button base are brought into close communication during assembly, the spindle retainer slides along the spindle. In the configuration shown in FIG. 2, the first end of spindle 14 fits inside the right-hand side of latch button 22. In this embodiment of the button assembly, screws are used to keep the button housing and the button base in the assembled configuration. In another embodiment, any type of mechanical connection known to one skilled in the art can be used to keep the button housing and the button base in the assembled configuration, including rivets, nails, bolts, or pins, among others.

As the button housing and the button base are brought into close communication during assembly, button clip 24 and spring 30 slide onto column 36 inside the latch button to holds spindle 14 in place. Spring 30 is biased to push the latch button out of the button assembly and keep spindle 14 in the retracted configuration. When the user pushes the button assembly into the button assembly during use, the spring is pushed against its bias and the latch button is free to push the spindle into the extended configuration.

Figure 3:
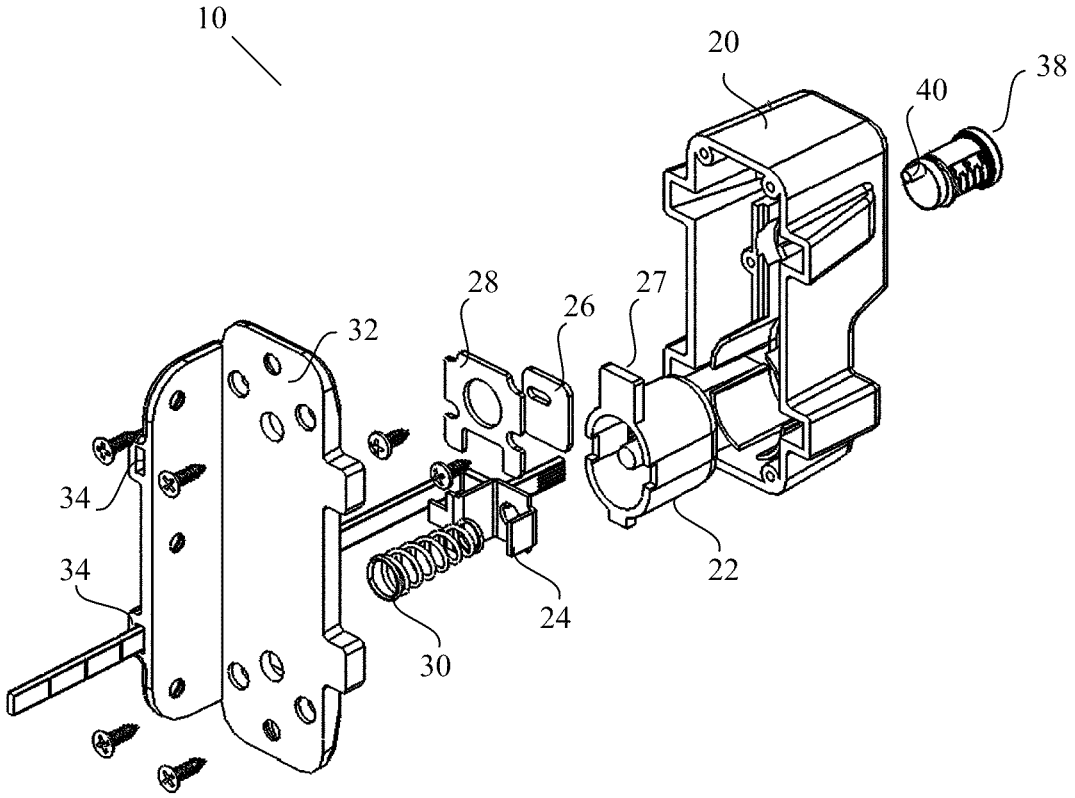
FIG. 3 is an exploded view of the button assembly in a reverse-handedness compared to FIG. 2.

One advantage of the present gate latch is that it can be installed in either a left-handed or right-handed configuration depending upon the design of the gate. For example, the latch can be assembled and affixed to a fencepost or other structure on either side of a gate, with the button assembly 10 on either the outside or the inside of the gate. FIG. 3 is an exploded view of the button assembly in a reverse-handedness compared to FIG. 2. In this configuration, the first end of spindle 14 fits inside the left-hand side of latch button 22. The button base is also in a left-handed configuration. The presence of two hollowed spindle retainers 34 on the button base allows the base to adopt either a left-handed or right-handed configuration without requiring additional hardware.

In a preferred embodiment of the present invention the length of spindle 14 is adjustable so that the gate latch can be installed on gates or structures of various sizes. In FIG. 3, for example, spindle 14 is scored such that the installer can break off the spindle at the proper length depending upon the width or size of the structure. In other embodiments the method of adjustment can be according to any method or device known to those skilled in the art.

Yet another advantage of the present invention is that it can optionally be locked from either side of the gate. FIG. 3 shows an embodiment of the button assembly that includes a locking mechanism. The assembly is similar to the assembly in FIG. 2, with the addition of a cam follower 26, a cam retainer 28, and a wafer cylinder 38. The cam 40 works with the cam follower and retainer to allow the wafer cylinder to lock and unlock the latch button from user manipulation. Alternatively, the locking mechanism can be any device or method of locking known to those in the art. In a preferred embodiment, the locking mechanism is located above the button in the button housing. This prevents contaminants such as mud, ice, snow, leaves, and other debris from interfering with operation of the latch button. Also in a preferred embodiment, the locking mechanism operates independently from the button thereby enhancing the robustness of the button assembly. As shown in FIG. 3, rotation of the cam causes cam follower 26 to move up or down. In the down position the cam follower sits in the path of the button extension 27 and prevents the user from pushing the button inward. In the up position the cam follower is no longer in the path of button extension 27 and the user can push the button inward. Among other advantages, an independent button mechanism reduces the number of parts in the button assembly, simplifies assembly and installation, and reduces the possibility of breakage.

Figure 4A:
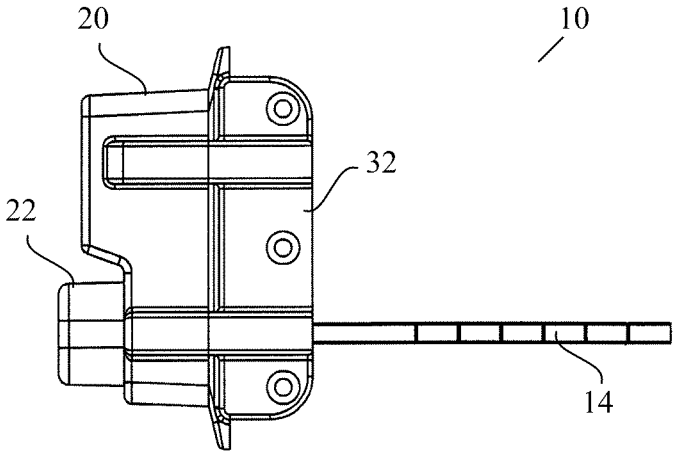
FIG. 4A is a side view of the assembled button assembly according to one embodiment of the present invention.
Figure 4B:
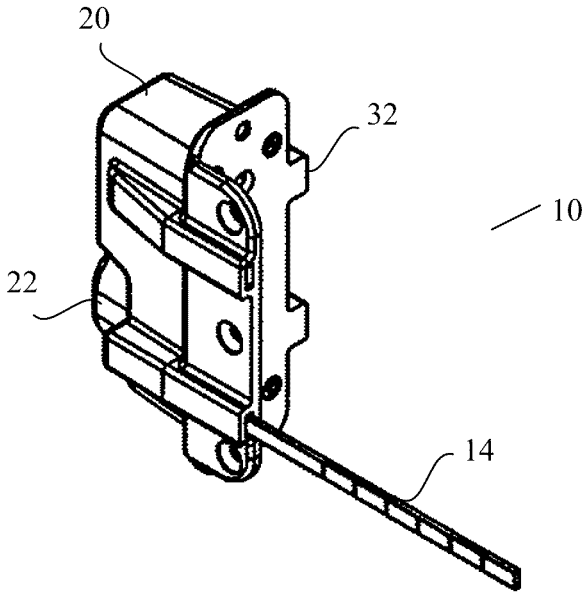
FIG. 4B is a perspective view of the assembled button assembly of FIG. 4A.

FIG. 4A is a side view of assembled button assembly 10 with the keeper base 32, button housing 20, the latch button 22, and spindle 14. FIG. 4B is a perspective view of an assembled button assembly.

Figure 5:
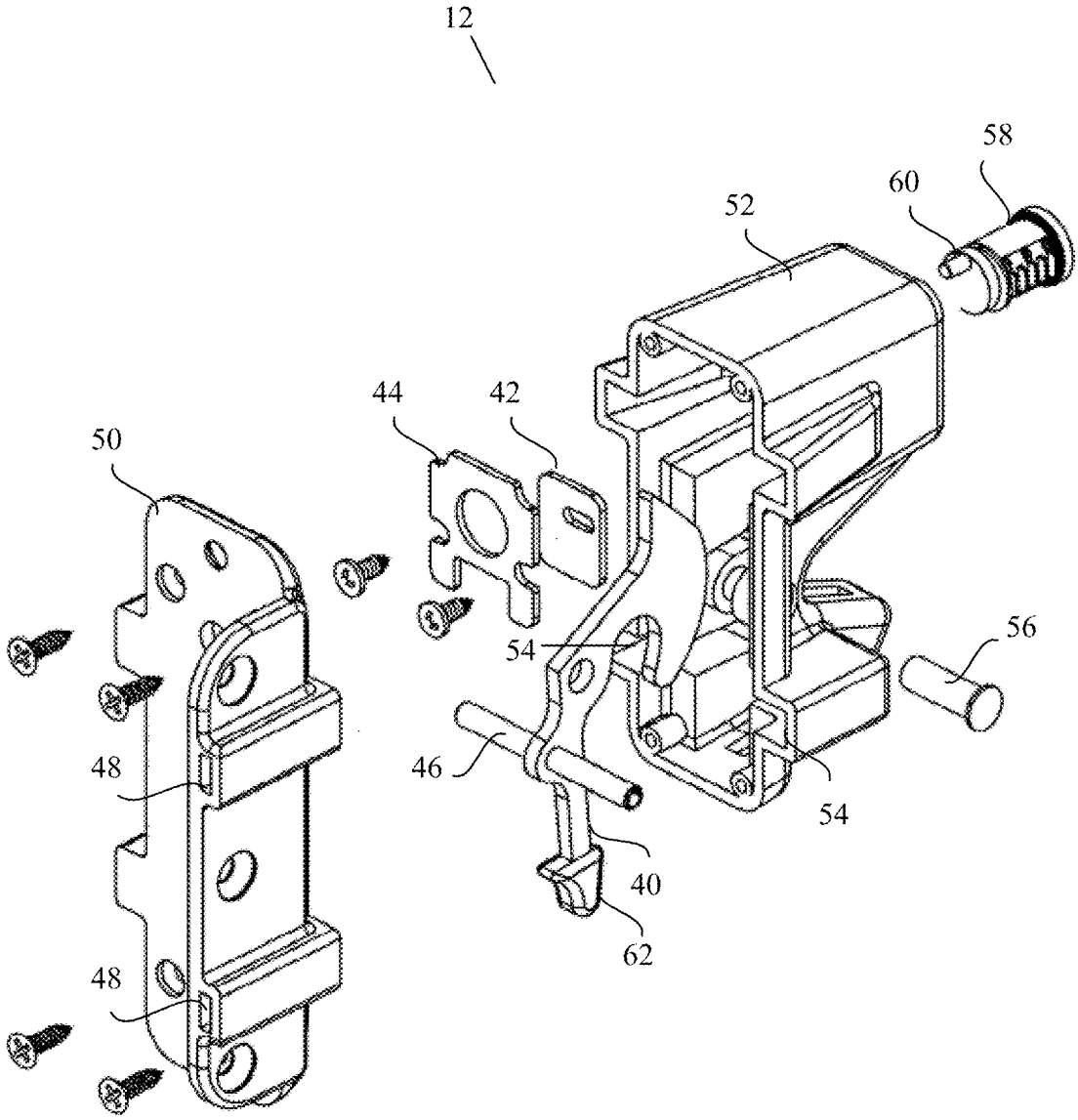
FIG. 5 is an exploded view of the latch assembly according to one embodiment of the present invention.
Figure 6:
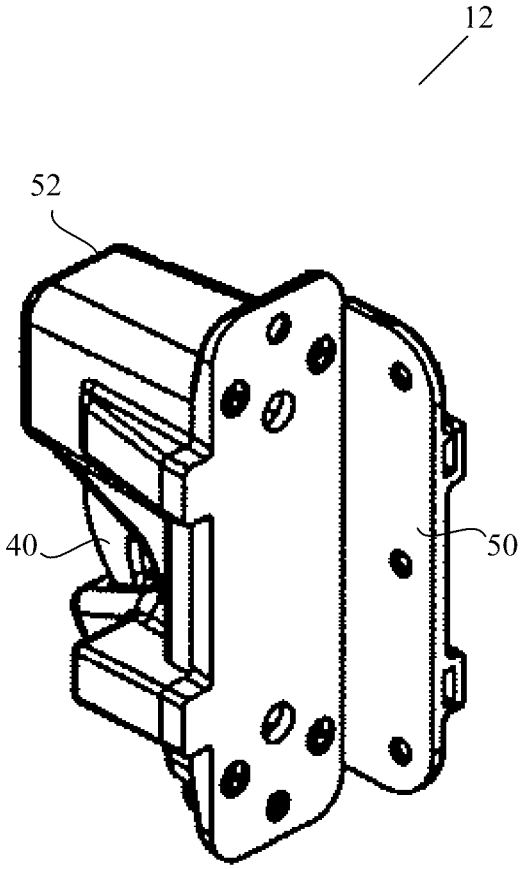
FIG. 6 is a reverse view of the assembled latch assembly of FIG. 5.

FIG. 5 is an exploded view of one embodiment of latch assembly 12. When fully assembled, the latch housing 52 retains the latch 40, the latch pin 46, the cam follower 42, and the cam retainer 44. When the button assembly and the latch assembly are in communication, the second end of spindle 14 is disposed through one of two hollowed spindle retainers 48 on the latch base 50. As the latch housing and the latch base are brought into close communication during assembly, spindle retainer 48 slides along the spindle. Also during assembly, latch 40 is placed inside latch housing 52 with the ends of the latch pin 46 sliding into a pin receptacle 54 on either side of the housing. Once the latch is in place, rivet 56 slides through an opening in the latch such that the latch can rotate at least partially around the rivet. The rivet can alternatively be anything upon which the latch can pivot, including but not limited to a nail, pivot, pin, or other structure. When the latch is correctly in place, a grip 62 is located outside the latch assembly such that a user can pull on it or push on it, thereby forcing the latch to at least partially rotate around the pivot. FIG. 6 shows an assembled latch assembly according to one embodiment of the present invention. Similar to the button base, the latch base can be assembled in either a left-handed or right-handed configuration depending upon the design of the gate. For example, the latch can be assembled and affixed to a fencepost or other structure on either side of a gate, with the latch assembly 10 on either the outside or the inside of the gate. Although only one configuration is shown in the figures, it should be understood that the invention is not limited to that configuration.

In this embodiment of the button assembly, screws are used to keep the latch housing and the latch base in the assembled configuration. In another embodiment, any type of mechanical connection known to one skilled in the art can be used to keep the latch housing and the latch base in the assembled configuration, including rivets, nails, bolts, or pins, among others.

As described above, it is an advantage of the present invention is that it can optionally be locked from either side of the gate. FIG. 5 shows an embodiment of latch assembly 12 that includes a locking mechanism, including cam retainer 44, cam follower 42, and a wafer cylinder 58. The cam 60 works with the cam follower and retainer to allow the cylinder to lock and unlock the latch from user manipulation. Alternatively, the locking mechanism can be comprised of any locking means or device known to those skilled in the art of locks. In a preferred embodiment, the locking mechanism is located above the latch in the latch housing. This prevents contaminants such as mud, ice, snow, leaves, and other debris from entering the latch housing or otherwise interfering with operation of the latch.

Figure 7:
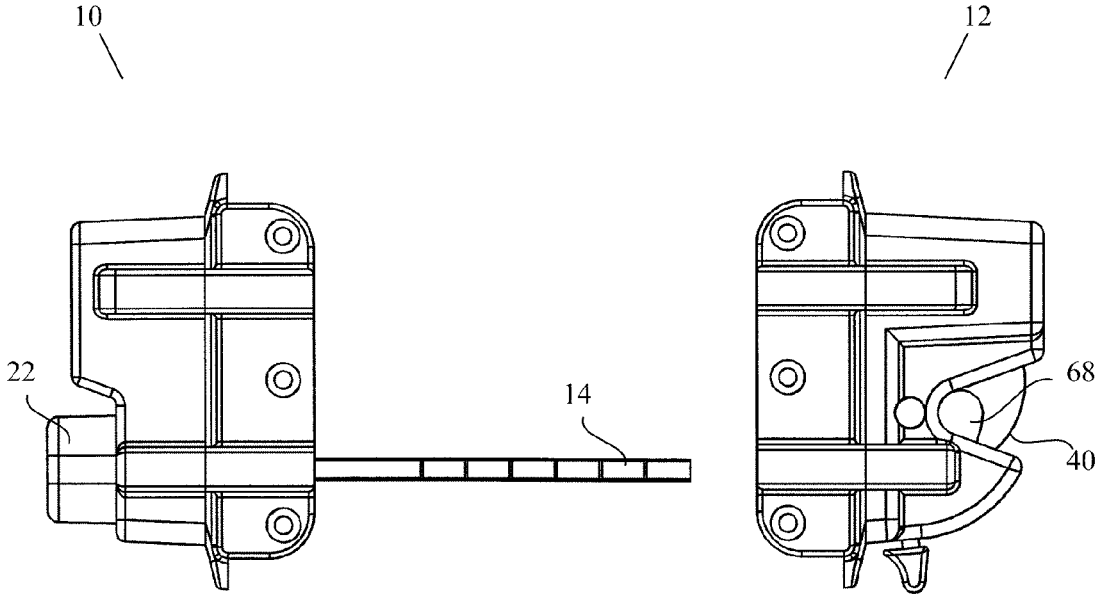
FIG. 7 is a side view of the button assembly and the latch assembly.

FIG. 7 is a side view of button assembly 10 and latch assembly 12 after they are assembled but before they are affixed to a structure such as a gate or gate post. In this figure latch 40 is in the closed configuration, thereby creating an enclosed space 68 which can optionally enclose and hold the keeper pin 18 (shown in FIG. 8) when the keeper assembly and the latch assembly are in close proximity, such as when the gate is closed. Pulling on grip 62 will cause latch 40 to rotate at least partially around pivot 56, and the enclosed space created by the latch and the latch housing will open, thereby allowing the keeper pin to exit the space.

Alternatively, the user can force the latch to rotate from the button assembly 10. When the button assembly and the latch assembly are fully assembled and in communication, spindle 14 can optionally slide into the pin receptacle 54. The user can then push the latch button into the latch assembly against the spring bias, thereby pushing the spindle toward the latch assembly. The spindle will either initially enter or penetrate further into pin receptacle 54, push against latch pin 46, and cause latch 40 to at least partially rotate on pivot 56. The enclosed space 68 created by the latch and the latch housing will then open to allow keeper pin 18 to exit the space. In a preferred embodiment, spindle 14 is biased to a position were latch 40 is in a closed or locked configuration, but can be moved against its bias to a position where the latch is unlocked and free to open. In this embodiment, latch assembly 12 further includes a lock that can lock the button into the position corresponding to the spindle position such that latch 40 on the opposite side of the structure remains locked.

Figure 8A:
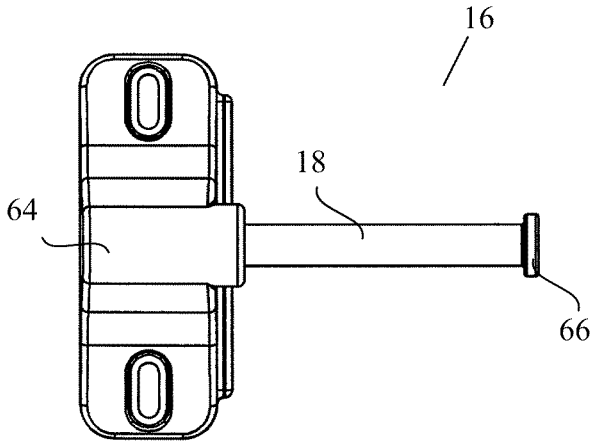
FIG. 8A is a side view of the keeper assembly.
Figure 8B:
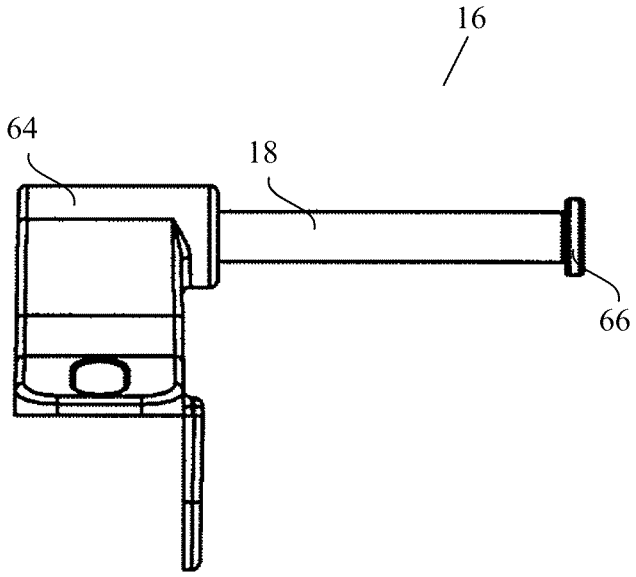
FIG. 8B is a top view of the keeper assembly.

FIGS. 8A and 8B are side and top views, respectively, of keeper assembly 16, consisting of keeper housing 64 and keeper pin 18. Keeper pin 18 optionally includes a retaining head 66 which prevents the keeper pin from exiting the enclosed space 68 created by latch 40 and latch housing 52.

Figure 9:
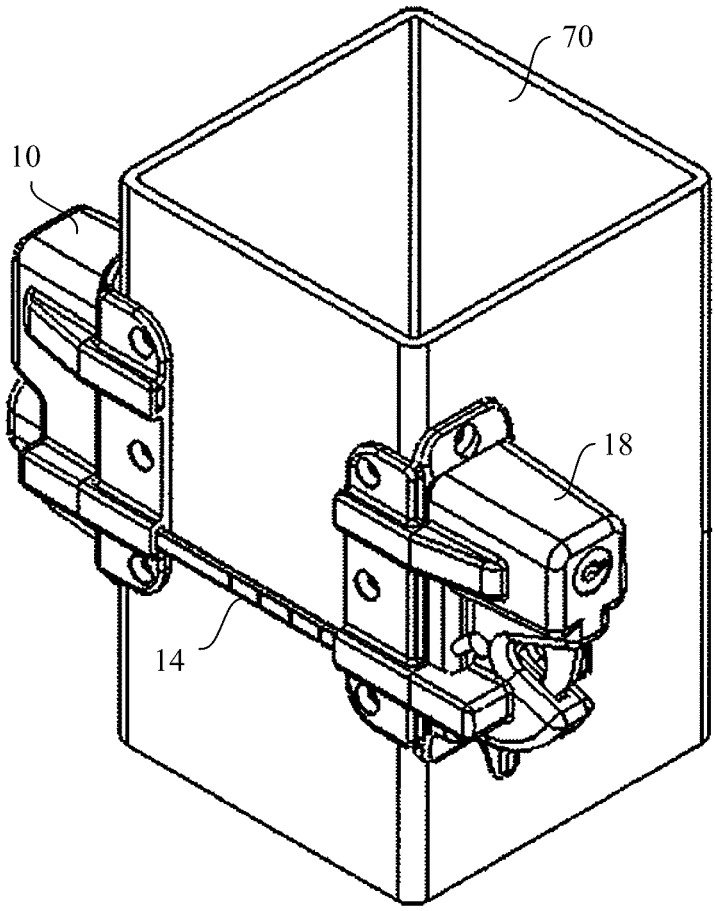
FIG. 9 is a side view of the button assembly and the latch assembly attached to a gate post.
Figure 10:
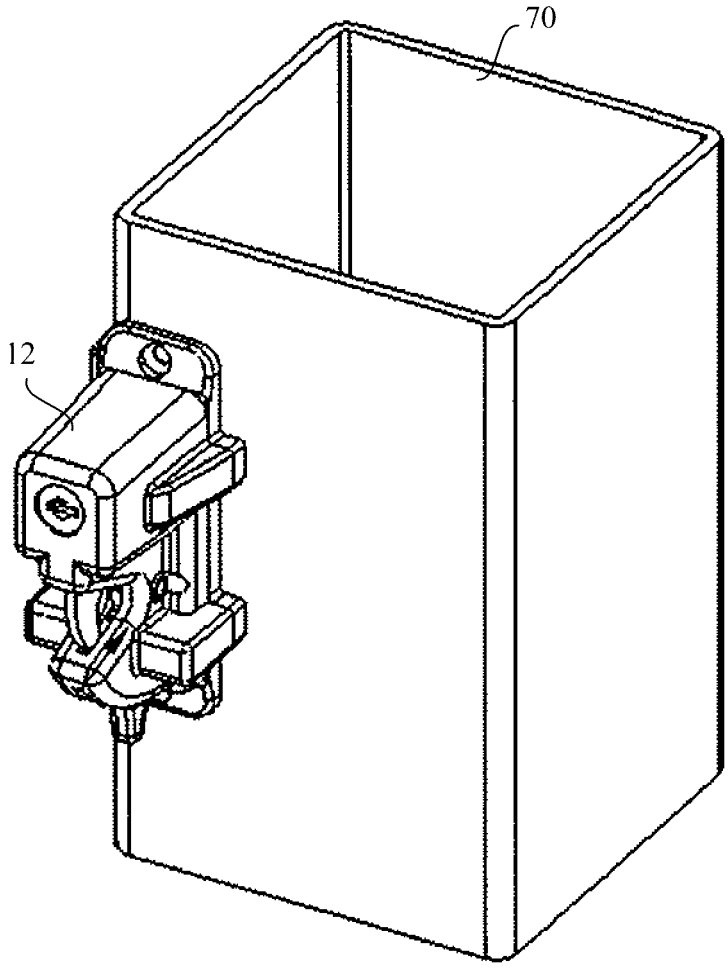
FIG. 10 is a side view of the latch assembly attached to a gate post.

FIG. 9 is a side view of the button assembly 10 and the latch assembly 12 affixed to a structure 70 such as a gate post. Spindle 14 is in communication with both the latch and button assemblies. FIG. 10 is a side view of the latch assembly attached to structure 70. In this embodiment the latch and button assemblies are affixed to structure 70 with screws, but in another embodiment any type of connection known to one skilled in the art can be used, including but not limited to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections, latches and/or magnetic connections).

In a preferred embodiment, one end of spindle 14 is positioned within the button assembly and the second end is positioned within the latch assembly, as shown in FIG. 9. This design confers several advantages, including keeping moisture and debris out of the housings and eliminating potential snag and pinch points for the moving parts.

Although the present invention has been described in connection with a preferred embodiment, it should be understood that modifications, alterations, and additions can be made to the invention without departing from the scope of the invention as defined by the claims.

What is claimed is:

1. A latch system adapted to secure a movable gate relative to a fixed post, said system comprising a latch assembly adapted for mounting on said fixed post, a button assembly adapted for mounting on said fixed post, a keeper assembly adapted for mounting on said gate, and a spindle external to said fixed post;

said keeper assembly comprising a keeper housing, and a keeper pin;

said button assembly comprising a button base mountable on said fixed post, a button housing mounted on said button base, a first end of said spindle extendably mounted on said button base, and a spring adapted to bias said spindle in a normally retracted position, said button assembly further comprising a button assembly mounting plate haying a button assembly mounting plate mounting surface extending perpendicularly to a button base mounting surface formed on said button base, said button assembly mounting plate mounting surface extending along an axis parallel to said spindle, the button assembly mounting plate adapted to be mounted to an external surface of said fixed post;

said latch assembly comprising a latch base mounted on said fixed post, a latch housing mounted on said latch base, a latch pivotally coupled to said latch housing for movement with respect to the latch housing between a first position wherein an outward end of the latch engages the keeper pin and a second position wherein the latch disengages from the keeper pin, said latch assembly further comprising a latch assembly mounting plate having a latch assembly mounting plate mounting surface extending perpendicularly to a latch base mounting surface formed on said latch base, said latch assembly mounting plate mounting surface extending along an axis parallel to said spindle, the latch assembly mounting plate adapted to be mounted to an external surface of said fixed post;

said latch assembly being adapted to be cooperatively arranged with said keeper assembly so that said outward end of said latch engages said keeper pin when said movable gate is in proximity to said fixed post; and said spindle being movable at said first end into an extended position wherein a second end of said spindle is adapted to pivotally move said latch into said second position further wherein at least a first portion of said spindle extends through said button assembly mounting plate, and wherein at least a second portion of said spindle extends through said latch assembly mounting plate, such that said spindle is mountable external to the post.

2. The system of claim 1, wherein said button assembly further comprises a button moveable between a first position and a second position.

3. The system of claim 2, wherein when said button occupies said first position said spindle occupies a first position and said latch is closed, and when said button occupies said second position said spindle occupies a second position and said latch is open.

4. The system of claim 1, wherein said button assembly further comprises a locking mechanism, wherein said when said locking mechanism is locked, said spindle is locked in said retracted position, and when said locking mechanism is unlocked, said spindle is free to move between said retracted position and said extended position.

5. The system of claim 4, wherein said button assembly further comprises a button moveable between a first position and a second position.

6. The system of claim 5, wherein said locking mechanism is positioned above said button.

7. The system of claim 5, wherein said locking mechanism is adapted to operate independently from said button.

8. The system of claim 1, wherein said latch assembly comprises a locking mechanism, wherein when said locking mechanism is locked, said latch is locked in a first position and said outward end of said latch engages said keeper pin, and when said locking mechanism is unlocked, said latch is free to disengage said keeper pin.

9. The system of claim 8, wherein said locking mechanism is positioned above said latch.

10. The system of claim 1, wherein the length of said spindle is adjustable.

11. The system of claim 1, wherein said first end of said spindle is positioned inside said button assembly.

12. The system of claim 1, wherein said second end of said spindle is positioned inside said latch assembly.

13. The system of claim 1, wherein said latch assembly further comprises a handle in communication with said latch, said handle adapted to pivot the latch between said first latch position and said second latch position.

14. The system of claim 1, wherein said button base is adapted for adjusting said button housing between a first position wherein said spindle is extendably mounted on the left side of said button base, and a second position wherein said spindle is extendably mounted on the right side of said button base.

15. The system of claim 1, wherein said latch base is adapted for adjusting said latch base between a first position wherein said spindle is movable into said extended position on the left side of said latch base, and a second position wherein said spindle is movable into said extended position on the right side of said latch base.

16. The latch system of claim 1, wherein said latch assembly and said button assembly are adapted for mounting on said gate, and said keeper assembly is adapted for mounting on said fixed post.

* * * * *